US009200839B2

(12) United States Patent
Viallon et al.

(10) Patent No.: US 9,200,839 B2
(45) Date of Patent: Dec. 1, 2015

(54) CONTAINER FOR THE TRANSPORT AND/OR STORAGE OF NUCLEAR MATERIALS, THE CONTAINER COMPRISING A MOBILE HEAT CONDUCTION STRUCTURE

(75) Inventors: Lilian Viallon, Bollene (FR); Roger Lahille, Azas (FR); Laurent Stachetti, Venejean (FR)

(73) Assignee: TN INTERNATIONAL, Montigny le Bretonneux (FR)

( * ) Notice: Subject to any disclaimer, the term of this patent is extended or adjusted under 35 U.S.C. 154(b) by 1008 days.

(21) Appl. No.: 12/595,499

(22) PCT Filed: Apr. 17, 2008

(86) PCT No.: PCT/EP2008/054635

§ 371 (c)(1),
(2), (4) Date: Jan. 19, 2010

(87) PCT Pub. No.: WO2008/135359

PCT Pub. Date: Nov. 13, 2008

(65) Prior Publication Data

US 2010/0119029 A1 May 13, 2010

(30) Foreign Application Priority Data

Apr. 18, 2007 (FR) ..... 07 54551

(51) Int. Cl.

| | |
|---|---|
| ***G21C 19/00*** | (2006.01) |
| ***F26B 21/00*** | (2006.01) |
| ***F24F 13/06*** | (2006.01) |
| ***G21F 5/008*** | (2006.01) |
| ***G21F 5/10*** | (2006.01) |
| *F24F 13/14* | (2006.01) |

(52) U.S. Cl.
CPC ..... *F26B 21/004* (2013.01); *F24F 13/06* (2013.01); *G21F 5/008* (2013.01); *G21F 5/10* (2013.01); *F24F 2013/0608* (2013.01); *F24F 2013/1493* (2013.01); *F24F 2221/14* (2013.01)

(58) Field of Classification Search
CPC ..... G21F 5/00–5/008; G21F 5/06; G21F 5/10
USPC ..... 376/272; 250/506.1, 507.1
See application file for complete search history.

(56) References Cited

U.S. PATENT DOCUMENTS

| | | | | |
|---|---|---|---|---|
| 4,147,938 | A * | 4/1979 | Heckman et al. | 250/506.1 |
| 4,326,130 | A * | 4/1982 | Ahner et al. | 250/506.1 |
| 7,119,349 | B1 * | 10/2006 | Shimojo et al. | 250/507.1 |

FOREIGN PATENT DOCUMENTS

| | | |
|---|---|---|
| EP | 0 338 477 A1 | 10/1989 |
| EP | 1 103 984 A1 | 5/2001 |

(Continued)

OTHER PUBLICATIONS

International Search Report, PCT/EP2008/054635, dated Jul. 4, 2008.

*Primary Examiner* — Peter M Poon
*Assistant Examiner* — Marshall O'Connor
(74) *Attorney, Agent, or Firm* — Nixon Peabody LLP

(57) ABSTRACT

A storage space device for the transport and/or storage of nuclear materials, comprising a main structure defining at least one housing intended to contain the nuclear materials and includes a mobile heat conduction structure forming at least one portion of a side outer surface of the storage space device. The mobile structure has at least one mobile heat conduction component mounted on the main structure so as to be displaceable reversibly from a retracted position to a deployed position while moving away from the structure.

15 Claims, 13 Drawing Sheets

(56) References Cited

FOREIGN PATENT DOCUMENTS

| | | | |
|---|---|---|---|
| EP | 1 122 745 | A1 | 8/2001 |
| WO | 2006019307 | A1 | 2/2006 |
| WO | 2007019704 | A1 | 2/2007 |

* cited by examiner

CONTAINER FOR THE TRANSPORT AND/OR STORAGE OF NUCLEAR MATERIALS, THE CONTAINER COMPRISING A MOBILE HEAT CONDUCTION STRUCTURE

CROSS REFERENCE TO RELATED APPLICATIONS OR PRIORITY CLAIM

This application is a national phase of International Application No. PCT/EP2008/054635, entitled "CONTAINER FOR THE TRANSPORT AND/OR STORAGE OF NUCLEAR MATERIALS, THE CONTAINER COMPRISING A MOBILE HEAT CONDUCTION STRUCTURE", which was filed on Apr. 17, 2008, and which claims priority of French Patent Application No. 07 54551, filed Apr. 18, 2007.

DESCRIPTION

1. Technical Field

The present invention generally relates to the field of transport and/or storage of nuclear materials, such as assemblies of nuclear fuel, and in particular of fresh fuel, for example of the Mox type.

Nevertheless, the invention may also be applied to the field of transport and/or storage of irradiated fuel assemblies, without departing from the scope of the invention.

It may further find application in the field of transport and/or storage of other types of nuclear materials, i.e. more particularly nuclear materials releasing significant heat power, such as vitrified waste also designated as <<glasses>> and corresponding to fission products.

2. State of the Prior Art

Conventionally, in order to ensure transport and/or storage of nuclear fuel assemblies, storage devices are used also called storage <<basket>> or <<rack>>. These storage space devices, usually of cylindrical shape and with a substantially circular section, have a plurality of adjacent housings each able to receive a nuclear fuel assembly. Further, the storage space device is intended to be housed in the cavity of a package in order to form together with the latter a container for the transport and/or storage for a nuclear fuel assembly, in which the nuclear material is perfectly confined.

It should be noted that the storage space device is generally removable. In other words, it is designed so as to make its loading possible and easy in the cavity of the package. Operating play is thereby provided between the cavity of the package and the storage space device for allowing these loading/unloading operations of the basket.

It is usually sought to obtain satisfactory heat conduction between the basket and the package, with the purpose of discharging towards the outside of the container, the significant heat released by the fuel assemblies.

This heat discharge is partly sought in order to observe the criterion of maximum allowed temperature for fuel assemblies. Indeed, if this temperature is exceeded, the integrity of the fuel pencils which form the assemblies may be embrittled because of the potential degradation of the mechanical characteristics of the sheaths of these pencils.

Moreover, it should be noted that the mechanical resistance of the basket should be compatible with the safety regulatory requirements for the transport/storage of nuclear materials, notably with respect to so-called free-fall tests. Now the mechanical characteristics of the materials used for making the basket may substantially degrade depending on the temperature, in particular when these materials are aluminium or one of its alloys. Evacuation of heat between the basket and the package is therefore also sought so as to guarantee satisfactory mechanical strength of the basket.

For economic reasons, the side inner surface delimiting the cavity of the package is made with wide manufacturing tolerances. One of the drawbacks resulting from the use of wide manufacturing tolerances lies in the necessity of substantially increasing the play usually provided in order to make the loading possible and easy of a removable basket in the cavity of the package, as mentioned earlier. The observed play then fulfils a role of a heat insulator going against the sought global purpose of heat conduction between the basket and the package, and therefore makes it difficult to evacuate the heat released by the nuclear fuel assemblies.

SUMMARY OF THE INVENTION

The object of the invention is therefore to find a remedy to the drawbacks mentioned above, relating to achievements of the prior art.

To do this, the object of the invention is first of all a storage space device for the transport and/or storage of nuclear materials, such as preferably fresh nuclear fuel assemblies, comprising a main structure defining at least one housing intended to contain said nuclear materials, the device also including a mobile heat conduction structure forming at least one portion of a side outer surface of said storage space device, said mobile heat conduction structure comprising at least one mobile heat conduction member mounted on said main structure so as to be displaceable reversibly, from a retracted position to a deployed position, while moving away from said main structure.

The storage space device or storage basket according to the invention therefore has in an original way deployability allowing it to substantially increase the surfaces in contact with the side inner surface of the package, delimiting the cavity in which the basket is found. Heat transfer between the basket and the package is consequently ensured satisfactorily, without however requiring the use of narrow and costly manufacturing tolerances for making the side inner surface delimiting the cavity. Indeed, even the use of wide manufacturing tolerances leads to considering a larger play between the package and the basket than the one usually provided for allowing the loading of the latter, once the latter is housed inside the cavity, the heat conduction structure may then be deployed in order to obtain the desired contact surface between the basket and the cavity of the package, which limits or even entirely eradicates the detrimental effects discussed earlier relating to the presence of the initial large play forming a heat insulator.

The heat evacuation function provided by the heat conduction structure in the deployed position allows observance of the criterion of maximum allowed temperature for the fuel assemblies, or for all the other types of nuclear materials intended to be stored/transported. Therefore, with the configuration according to the invention, the risks of degradation of the protective sheaths of the assemblies and their risk of mechanical weakening are advantageously reduced to nil.

Finally, it is indicated that reducing the overall temperature within the storage basket, allowed by the heat condition structure, advantageously generates an increase in the life time of this basket, in particular when the latter is made in aluminium or in one of its alloys.

In the latter case, reducing temperature also contributes to more easily justifying the mechanical behaviour of the basket, notably during free-fall tests.

If, as this emerges from the foregoing, the heat conduction structure is preferably deployed until contact is established with the cavity of the package, it is also possible to contemplate less significant deployment, not leading to the aforementioned contact, without departing from the scope of the invention. Indeed, simple deployment of the heat conduction structure has the advantageous consequence of reducing the play initially provided between the basket and the package, so that heat transfer between both of these components is substantially improved.

By the reversibility of the displacement of the mobile component, the latter may be subsequently replaced in its retracted position, in order to in particular facilitate extraction of the basket out of the package.

Preferably, in at least one longitudinal half-section of the storage space device passing through a longitudinal axis of the latter and crossing the mobile heat conduction structure, the sum of the lengths of each mobile component of the crossed mobile structure, along the longitudinal axis of the storage space device, accounts for at least 20% of a total length of said storage space device along its longitudinal axis. Naturally, it is indicated that the larger the value of the percentage indicated above, the more satisfactory is the heat transfer ensured by the mobile heat conduction components.

Preferably, at least one mobile component is jointedly mounted on said main structure, along a joint axis parallel to a longitudinal axis of said storage space device. This device is perfectly suitable for obtaining longitudinal linear contact between the mobile component and the package cavity. In this respect, it is preferably proceeded in such a way that each of the mobile components of the structure is jointedly mounted on said main structure, along a joint axis parallel to the longitudinal axis of the storage space device.

Preferentially, the joint axis crosses a peripheral portion of said main structure.

Further, the side outer surface of at least one mobile component, and preferably of each of these components, assumes the shape of an angular portion of a cylindrical surface with a longitudinal axis parallel to a longitudinal axis of said storage space device, said angular portion being less than or equal to 180°. Thus, when they occupy their retracted position, the mobile components are able to participate in the formation of a side outer surface of the storage space device with a substantially cylindrical shape, and preferably with a circular section.

Preferably, at least one mobile component, and preferably each of these components, is jointed on said main structure at a longitudinal edge of this component.

Still preferentially, around a given longitudinal portion of said main structure, said mobile structure has a plurality of mobile heat conduction components, distributed peripherally. In such a case, it may be provided that in the refracted position of each of said plurality of mobile heat conduction components, the latter form a peripheral casing around said given longitudinal portion. The aforementioned casing may alternatively not be entirely formed by the plurality of mobile components, but also by means of fixed components relatively to the main structure, for example each placed between two consecutive mobile components in the peripheral direction.

Preferably, said peripheral casing of the given longitudinal portion is formed by two, three or four mobile heat conduction components, even if the number of these components may be larger, without departing from the scope of the invention.

Still preferentially, said mobile heat conduction structure comprises a plurality of mobile heat conduction elements distributed along a longitudinal direction of the storage space device. This preferred feature brings out the <<sectioned>> nature of the mobile structure along the longitudinal direction of the storage space device. Nevertheless, it would alternatively be possible to provide that each mobile component extends over substantially the whole length of the heat conduction structure in the direction of the longitudinal axis of the storage space device, without departing from the scope of the invention.

As mentioned earlier, it is possible to proceed in such a way that in the refracted position of each component of said mobile heat conduction structure, the latter substantially forms the entirety of the side outer surface of said storage space device. This expresses the fact that the entirety of the main structure is laterally <<covered>> by the mobile structure, although this may be otherwise, without departing from the scope of the invention. In this respect, it may be provided that only the upper and lower ends of the basket are not covered by the deployable heat conduction structure.

Preferentially, at least one mobile heat conduction component, and preferably each of these components, is returned to its retracted position or to its deployed position by elastic return means, for example of the spring type.

Preferably, the storage space device includes control means with which the displacement of each mobile heat conduction component may be generated from its retracted position towards its deployed position and vice versa, said control means being actuatable from the outside of the storage space device, and more preferentially externally actuatable from an upper end of the storage space device. As such, it is preferably provided that said control means comprise a control rod crossing said main structure parallel to a longitudinal axis of said storage space device. Further, it may be proceeded in such a way that said control means comprise a control member which may be actuated from a head plate of the storage space device.

Finally, it is recalled that the storage space device is preferentially applied to the transport and/or storage of fresh nuclear fuel assemblies, for example of the Mox type.

Another object of the present invention relates to a package comprising a cavity for housing a storage space device for the transport and/or storage of nuclear materials, said package comprising a main structure and said housing cavity being delimited by a side inner surface of said package. According to the invention the package also includes a mobile conduction structure forming at least one portion of said side inner surface of the package, said mobile heat conduction structure comprising at least one mobile heat conduction component mounted on said main structure, so as to be displaceable reversibly from a retracted position to a deployed position, while moving closer to a longitudinal axis of said housing cavity.

Thus, the advantages described above relating to the storage space device according to the present invention, likewise characterize the package according to the invention, given that the common design between both of these entities lies in the provision of a deployable heat conduction structure allowing improvement of the heat transfer between the basket and the package, while establishing contact between both of these entities, or, as mentioned above, by simply reducing the play initially provided between both of these components.

In particular, even if the use of wide manufacturing tolerances leads to considering a large play between the package and the basket in order to allow the loading of the latter, once the latter is housed inside the cavity, the heat conduction structure may then be deployed in order to increase the surfaces in contact with the storage space basket, which limits or even entirely eradicates the detrimental effects discussed earlier relating to the presence of the initial large play forming a heat insulator.

Moreover, the whole of the preferential features discussed above and associated with the storage space device may likewise apply to the package according to the invention. Nevertheless, only a few of them are recalled hereafter.

Preferably, in at least one longitudinal half-section of the package passing through the longitudinal axis of said housing cavity and crossing the mobile heat conduction structure, the sum of the lengths of each mobile component of the crossed mobile structure, along the longitudinal axis of said housing cavity, accounts for at least 20% of a total length of said housing cavity along its longitudinal axis.

Preferably, at least one mobile component is jointedly mounted on said main structure of the package, along a joint axis parallel to the longitudinal axis of said housing cavity.

Preferably, said joint axis crosses an inner peripheral portion of said main structure of the package.

Preferably, the side inner surface of at least one mobile component assumes the shape of an angular portion of a cylindrical surface with a longitudinal axis parallel to the longitudinal axis of said housing cavity, said angular portion being less than or equal to 180°.

Preferably, at least one mobile component is jointed on said main structure of the package at a longitudinal edge of this component.

Still preferentially, at a given longitudinal portion of said main structure of the package, said mobile structure has a plurality of mobile heat conduction components, distributed peripherally, and therefore being used for delimiting the housing cavity. Preferably, in the retracted position of each of said plurality of mobile heat conduction components, the latter form a portion of a peripheral crown positioned internally relatively to said given longitudinal portion.

Preferably, said peripheral crown portion is formed by two, three or four mobile heat conduction components.

Preferably, said mobile heat conduction structure comprises a plurality of mobile heat conduction components distributed along a longitudinal direction of the housing cavity.

Preferably, at least one mobile heat conduction component is maintained in its retracted position or in its deployed position, by means of elastic return means.

Preferably, it further includes control means with which the displacement of each mobile heat conduction component may be generated from its retracted position to its deployed position and vice versa, said control means being actuatable from the outside of the package, and more preferentially externally actuatable from an upper end of the package.

Preferably, the control means comprise a control rod crossing said main structure of the package, parallel to the longitudinal axis of said housing cavity.

Another object of the present invention relates to a container for the transport and/or storage of nuclear materials, this container comprising a package as well as a storage space device removably placed in said package, said package being a package as described above, and/or said storage space device being a storage space device as described above.

In other words, the invention relates to a container for the transport and/or storage of nuclear materials, this container comprising a package as well as a storage space device removably placed in said package, and a mobile heat conduction structure including at least one mobile heat conduction component laid out so as to be displaceable reversibly from a retracted position to a deployed position so as to reduce the play existing between the storage space device and the package, or even for putting both of the these components in contact with each other, the mobile heat conduction structure being indifferently part of the storage space device and/or of the package.

Finally, the object of the invention is also a method for loading a storage space device, as described above, into a package so as to form a container for the transport and/or storage of nuclear materials, the method comprising a step for introducing said storage space device into the inside of a cavity defined by the package by means of an inner side surface of the latter, characterized in that it also comprises a subsequent step for deploying said mobile heat conduction structure. Preferably, this deployment is performed so that each mobile heat conduction component of said mobile structure will come into contact with said inner side surface delimiting said cavity of the package. Nevertheless, it is also possible to contemplate less significant deployment, not leading to the aforementioned contact, the purpose of which is to reduce the play initially provided between the basket and the package, so as to improve heat transfer between both of these components.

Other advantages and characteristics of the invention will become apparent in the non-limiting detailed description below.

BRIEF DESCRIPTION OF THE DRAWINGS

This description will be made with reference to the appended drawings wherein.

DETAILED DESCRIPTION OF PREFERRED EMBODIMENTS

Figure 1:
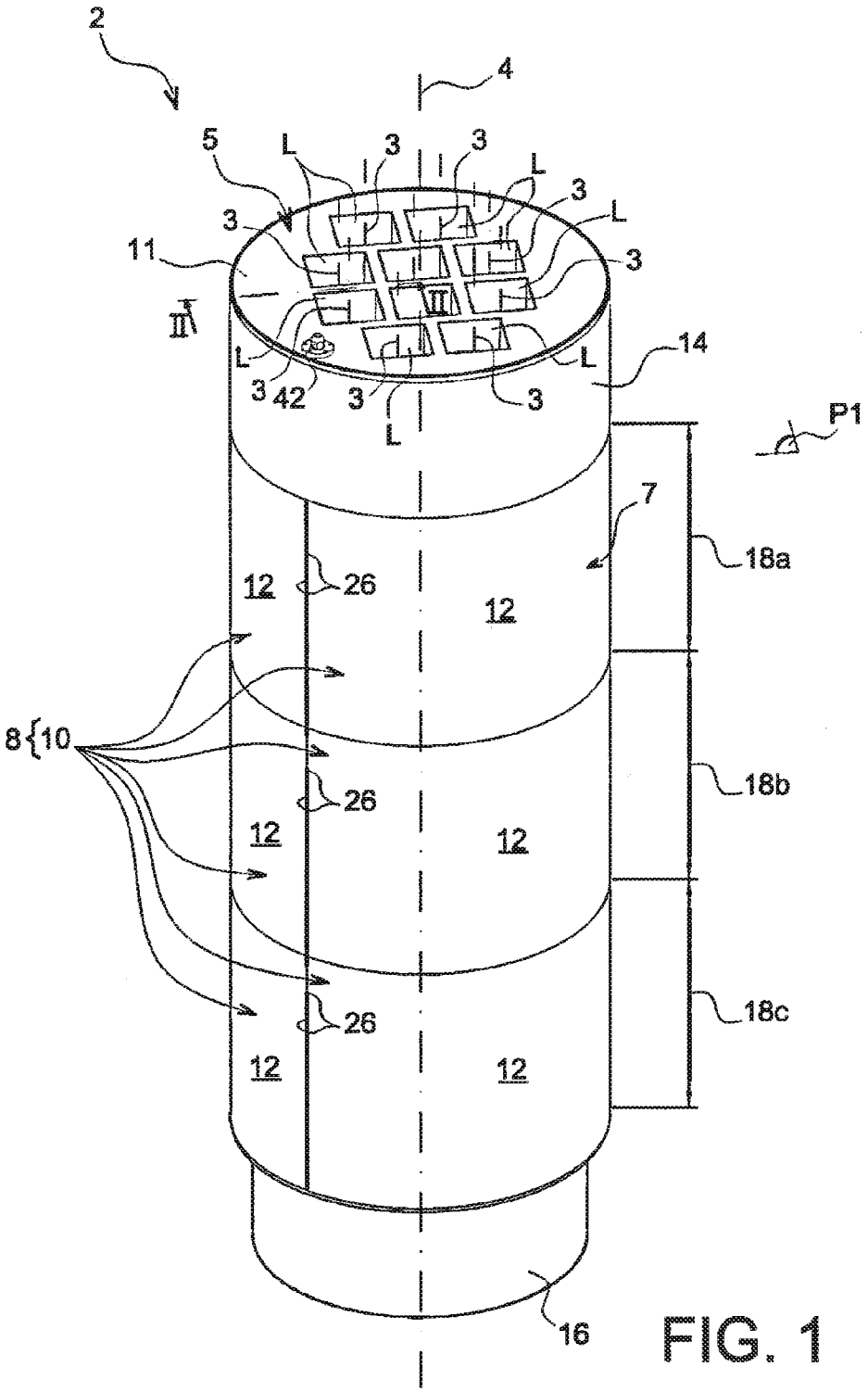
FIG. 1 illustrates a schematic perspective view of a storage space device for the transport and/or storage of nuclear fuel assemblies, according to a preferred embodiment of the present invention.

First of all with reference to FIG. 1, a storage space device 2 may be seen for the transport and/or storage of nuclear fuel assemblies, according to a preferred embodiment of the present invention.

The storage space device 2 is provided in order to be placed in a package (not shown on this figure) intended for the transport and/or storage of nuclear fuel preferably fresh assemblies (not shown), for example of the Mox type.

As this may be seen in FIG. 1, the storage space device 2 comprises a plurality of adjacent housings L positioned in parallel, the latter each extending according to a housing longitudinal axis 3 parallel to a longitudinal axis 4 of the device/basket 2. The housings L are defined by a main structure 5 of the basket, also called central structure, and are each capable of receiving at least one fuel assembly with a square or rectangular section, and preferably a single one. They are each delimited by an inner surface, the transverse section of which preferably assumes the shape of a square or of a rectangle.

In the following of the description, the term of <<longitudinal> should be understood as parallel to the longitudinal axis 4 of the basket, and the term of <transverse>> should be understood as orthogonal to this same longitudinal axis 4.

The design of the main structure 5 of the storage space device 2 may be of any shape known to one skilled in the art, such as for example of the type based on the stacking of wafers crossed by housing delimiting sleeves, or further of the type aimed at obtaining housings L juxtaposed to each other via a plurality of structural assemblies with stacked and intertwined notches.

It is noted that the storage base device 2 is shown in a vertical position for loading/unloading fuel assemblies, different from the horizontal/laid position usually adopted during the transport of the assemblies. Indeed, as this is known to one skilled in the art, these assemblies are intended to be introduced beforehand in the housings L with the vertically laid-out device 2, i.e. resting on a bottom located at one end of the device opposite to the one bearing a head plate 11, through which the assemblies pass before penetrating into their respective housings.

The storage space basket 2 comprises a side outer surface 7, a large part of which is formed by the side outer surface 12 of mobile components 10 belonging to the mobile heat conduction structure 8, which will be detailed hereafter. Indeed, in the described preferred embodiment, this is expressed by the fact that the quasi-integrality of the main structure 5 is laterally covered by the mobile structure 8, since only the upper 14 and lower 16 ends of the basket 2 are not covered by the mobile heat conduction components 10.

Still with reference to FIG. 1, it is seen that the portion of the main structure 5 laterally covered by the mobile structure 8, i.e. the portion located between the ends 14 and 16 of the basket, is cut into three sections or adjacent longitudinal portions, referenced from top to the bottom by 18*a*-18*c*. Naturally, the number of sections may be different, depending on the encountered needs and constraints.

At each of these sections 18*a*-18*c*, the structure 8 includes two mobile components 10 distributed angularly/peripherally, and each extending over an angular sector of about 180° in order to form together a peripheral casing around the relevant longitudinal portion 18*a*-18*c*, and this when the mobile components 10 occupy a retracted position as it will be described subsequently.

The three thereby formed peripheral casings are adjacent in the longitudinal direction of the basket 2, and may therefore be assimilated to a same and unique substantially continuous casing, extending all around the main structure 5 and substantially on the quasi-totality of the length of the basket 2.

Figure 2:
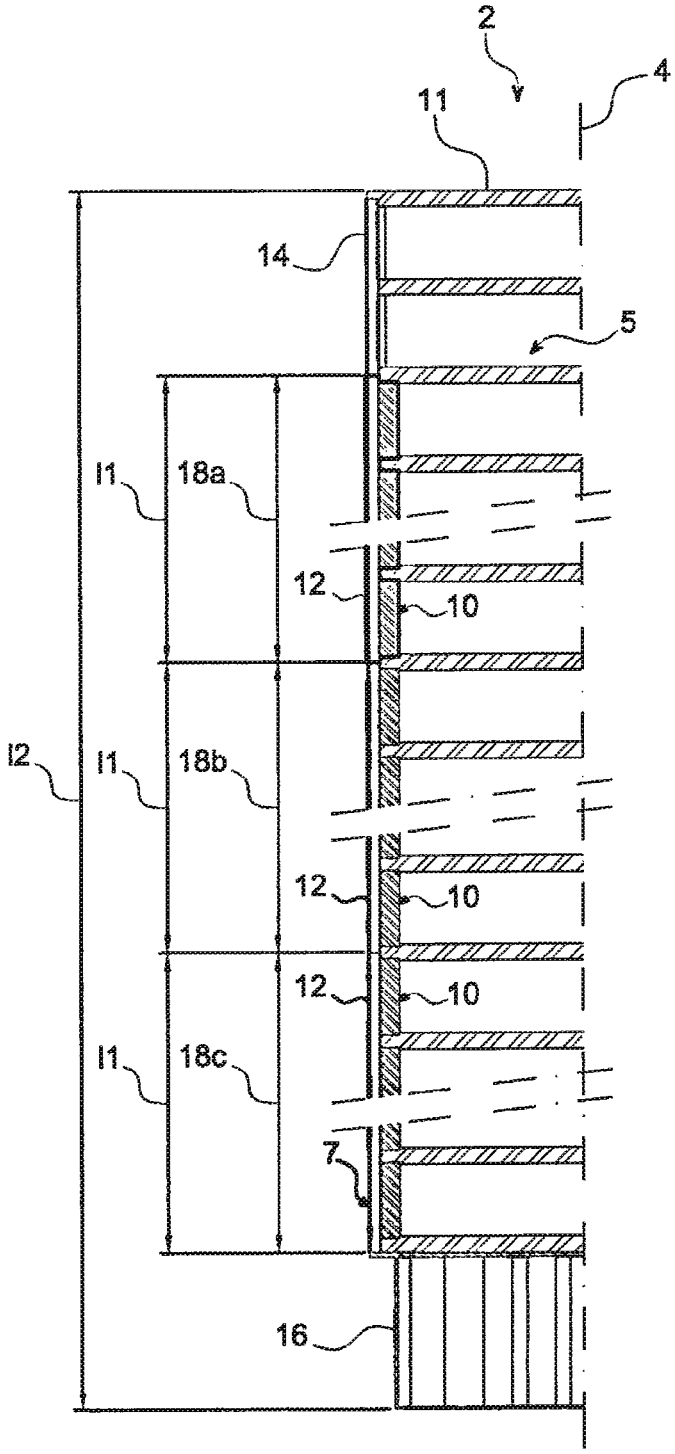
FIG. 2 illustrates a schematic longitudinal half-section of the storage space device, taken along the line II-II of FIG. 1.

In this respect, with reference to FIG. 2, it is preferably provided that in any longitudinal half-section of the device 2 passing through its axis 4 and crossing the mobile heat conducting structure 8, the sum of the lengths 11 of each crossed mobile component 10 along the axis 4, accounts for at least 20% of a total length 12 of the storage space device 2 along this same axis 4.

In other terms, in the preferred described embodiment, in which the total length 12 corresponds to the sum of the three lengths 11 to which the length of both ends 14, 16 have to be added, the following relationship is verified:

$$3.11>(0.2).12$$

As such, it is indicated that the ratio 3.11/12 is preferably identical whatever the relevant longitudinal half-section, which expresses the fact that the deployable structure 8 has constant length all around the main structure 5.

Figure 3:
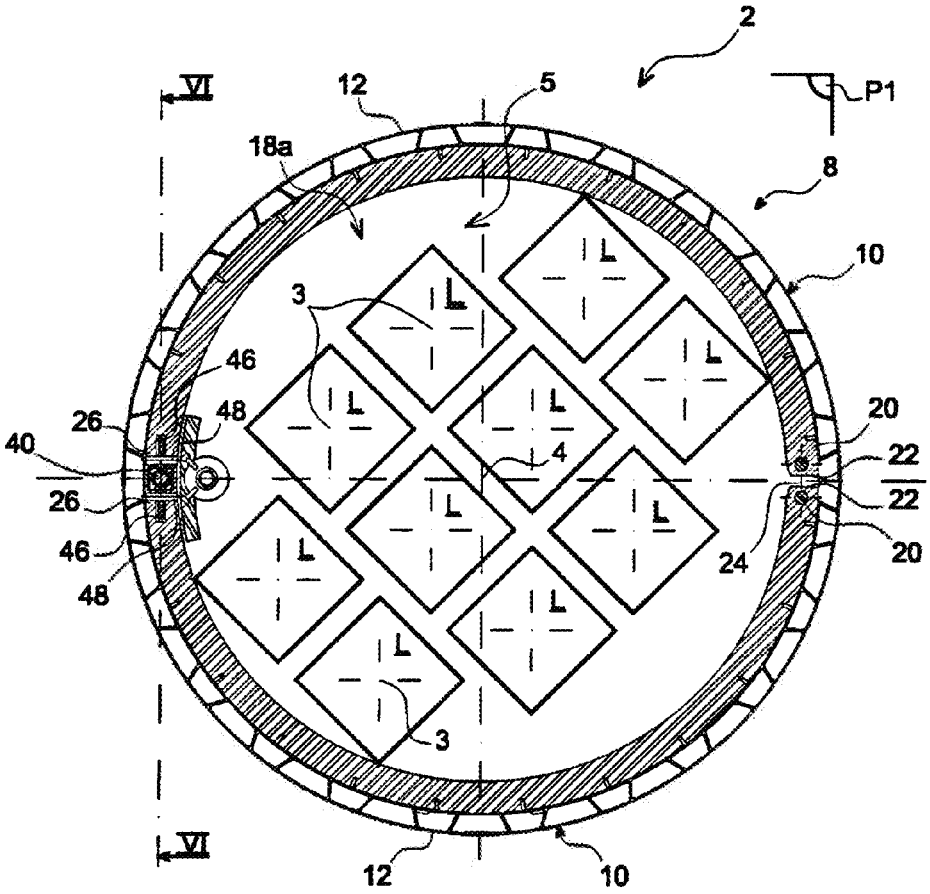
FIG. 3 illustrates a transverse sectional view taken along the plane P1 of FIG. 1.

With reference now to FIG. 3, it may be seen that for each of the longitudinal sections 18*a*-18*c*, each of the two mobile components 10 is jointedly mounted on the main structure 5, along a joint axis 20 parallel to the axis 4.

Thus, for each of the two mobile components 10, this joint axis 20 is preferably placed so that it is located at a jointed longitudinal edge 22 of the component, and so that it crosses a peripheral portion 24 of the main structure 5, as this is clearly visible in FIG. 3.

Further, still in this same figure, it may be seen that the side outer surface 12 of each of the two mobile components 10 assumes the shape of an angular portion of a cylindrical surface, with a circular section and a longitudinal axis parallel to the longitudinal axis 4, and preferably coinciding with the latter when the mobile component 10 occupies its illustrated retracted position.

As mentioned earlier, the angular portion is of the order of 180°, which allows both components 10 to form together a closed casing around the relevant longitudinal section, the side outer surface 12 of which, forming a portion of the side outer surface 7 of the basket 2, assumes the shape of a cylindrical portion with a circular section.

In the described preferred embodiment, both jointed longitudinal edges 22 are substantially placed facing each other, and are therefore positioned so as to be diametrically opposite to both free longitudinal edges 26 of the two mobile components. Of course, in the retracted position of the latter as shown in FIG. 3, both free longitudinal edges 26 are also substantially placed facing each other and possibly in contact.

One of the particularities of the present invention lies in the fact that each of the mobile heat conduction components 10 is mounted on the main structure 5 so as to be displaceable from the retracted position towards a deployed position which will be described hereafter, while moving away from the main structure 5, i.e. while moving away from the axis 4 by pivoting about its joint axis 20.

Figure 4:
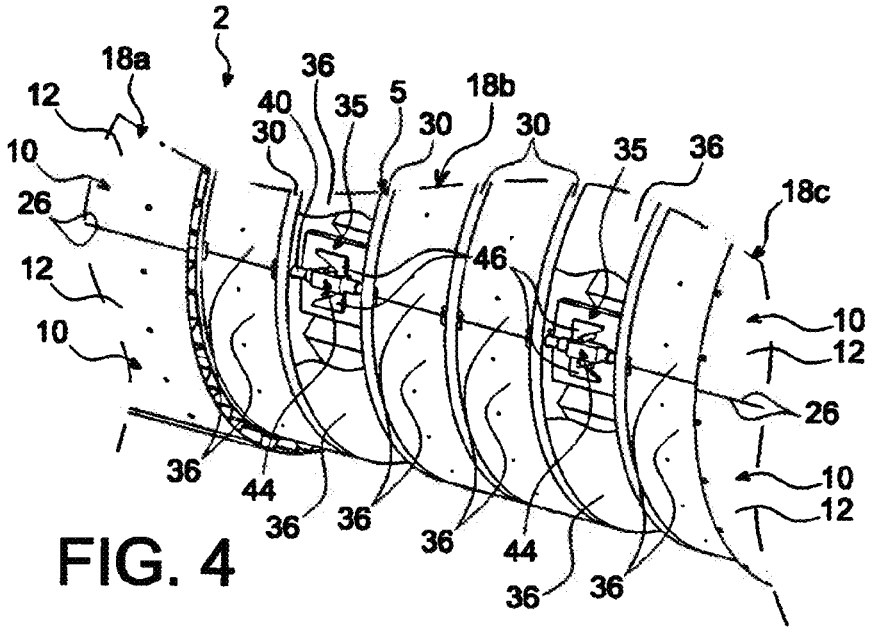
FIG. 4 illustrates a partial perspective view of the storage space device shown in the previous figures, wherein both mobile heat conduction components surrounding a longitudinal portion of the main structure of the device, have only been partly illustrated.

Now with reference to FIG. 4, the intermediate longitudinal section 18*b* was illustrated with only a portion of its two associated mobile components, so as to better understand the design of the main structure 5, and so as to show a portion of the control means allowing the setting into motion of the mobile heat conduction components 10.

Thus, it may be seen that the main structure 5 includes transverse wafers 30 longitudinally spaced from each other, their periphery forming together a single circumferential supporting surface with a cylinder shape and circular section, intended to be fitted to a side inner surface of the associated mobile component 10, in the retracted position. The annular spaces 35 located between two directly consecutive transverse wafers 30 are filled with semi-annular components 36, each therefore assuming the shape of a half-ring with a substantially square or rectangular section, these components 36 being an integral part of the mobile components 10, as this will be exposed below.

Thus, in each section 18*a*-18*c*, these are six annular spaces 35 which are left free so as to be able to be penetrated by the six semi-annular components 36 of the mobile components 10, respectively. It is noted that these components 36 are strongly involved in the heat transfer between the mobile component 10 and the main structure 5, at its wafers 30, this heat transfer allowing an improvement in the heat transfer between the basket and the cavity. For this, the required operating play between the wafers 30 and the semi-annular components 36 is set so as to be as small as possible.

Figure 5:
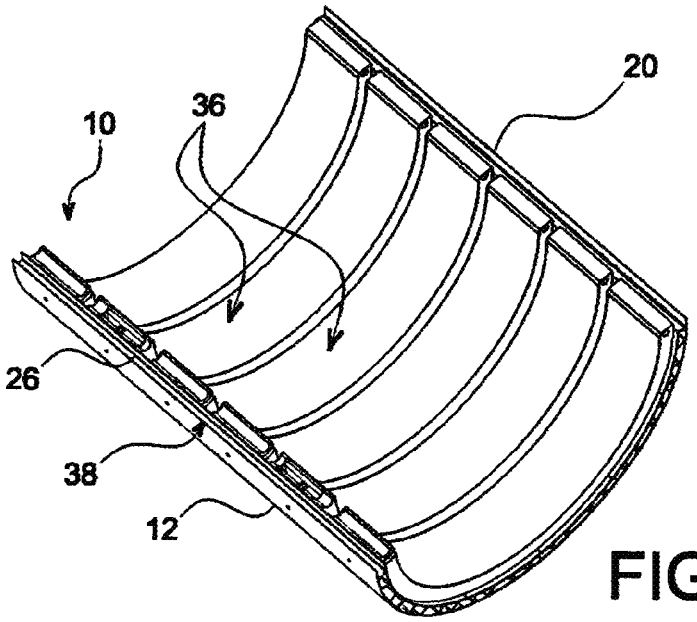
FIG. 5 illustrates a schematic perspective view of one of the two mobile heat conduction components partly illustrated in the storage space device of FIG. 4.

As this is visible in FIG. 5 illustrating a mobile heat conduction component 10 intended to be placed around the section 18*b* of the basket of FIG. 4, this component may roughly be made with a hollow cylinder portion 38 defining the side outer surface 12 and extending over about 180°, on which are added six components 36 each forming an internal portion of the associated mobile component 10. The internal portions 36 are then preferably with the same longitudinal axis, also corresponding to the longitudinal axis of the hollow cylinder portion 38.

Moreover, in each section 18*a*-18*c*, two of the six annular spaces 35, left clear so as to be able to be penetrated by the internal portions 36, house a portion of the means for controlling the setting into motion of these components, as this will now be detailed with reference to FIGS. 4-7.

The control means first of all comprise a control rod 40 crossing the main structure 5 parallel to the longitudinal axis 4, this control rod 40 being globally located between the free longitudinal edges 26 of the mobile components 10, as this is better visible in FIG. 3. The rod 40 substantially extends over the whole length of the basket 4, while crossing a periphery of the wafers 30, as this is visible in FIG. 6. On this same figure, it may be seen that the rod 40 bears an actuatable control member 42 laid out externally relatively to the basket, and more specifically mounted on the head plate 11 from which it is accessible.

The control means further include, at two annular spaces 35, for respectively receiving two internal portions 36 of a mobile component 10, a sliding retaining module 44 cooperating with the free longitudinal edge 26 of each of the mobile components 10. As an indication, both relevant components correspond to the second and fifth components 36 along the direction of the axis 4, although this may naturally be otherwise depending on the encountered needs and constraints.

Figure 6:
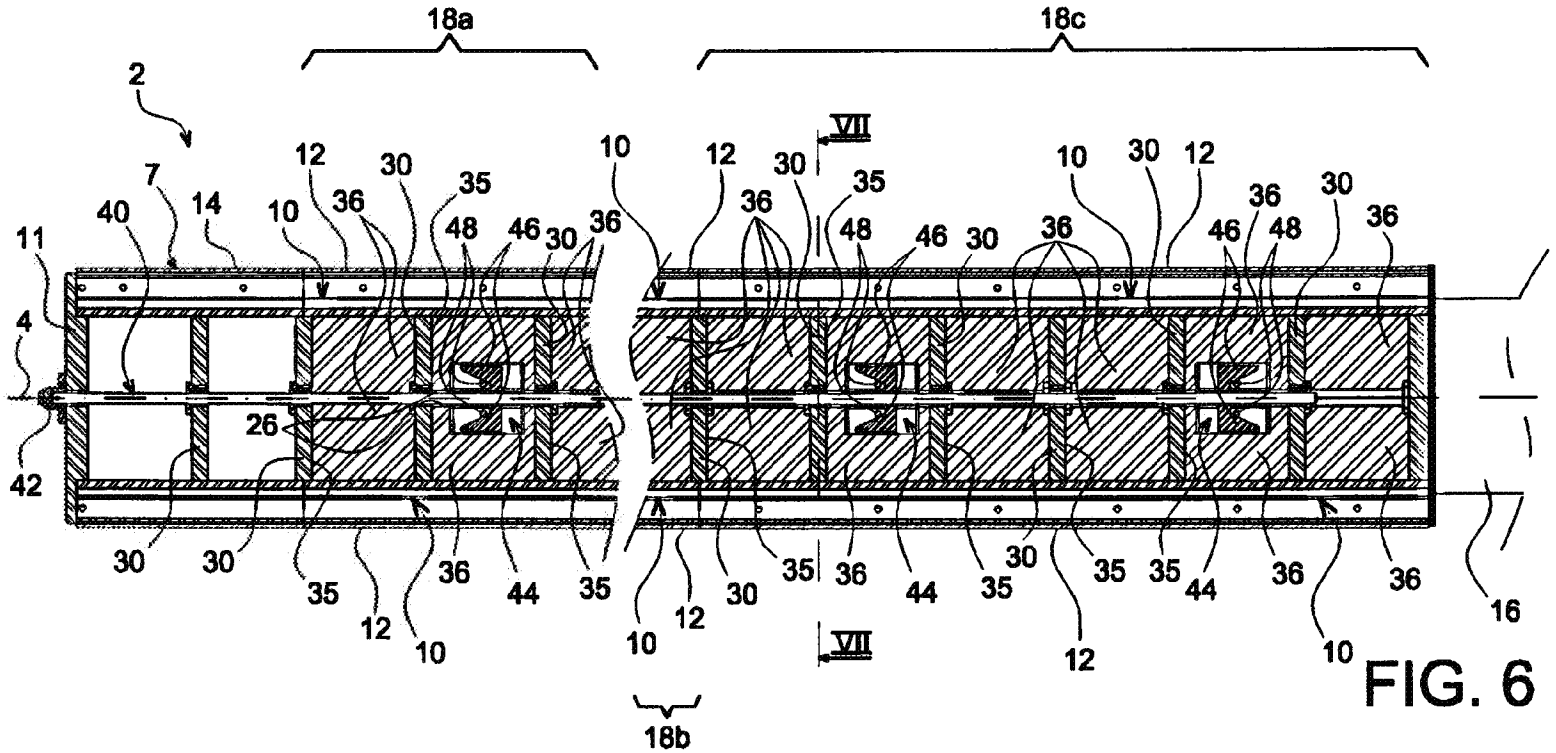
FIG. 6 illustrates a longitudinal sectional view of the storage space device, taken along the line VI-VI of FIG. 3.

More specifically and with reference to FIG. 6, it may be seen that each sliding retaining module 44 includes two guiding ramps 46 positioned on either side of the control rod 40, these ramps 46 respectively cooperating with two guided pins 48, respectively firmly attached to two free facing edges 26 and more specifically to two internal facing portions 36.

Moreover, each module 44 is mounted via a threaded connection on the control rod 40, which fulfils the function of a worm screw. Therefore, upon setting into rotation the rod 40 around its own axis, via the control member 42, each of the retaining modules 40 moves relatively with respect to the main structure 5, along the direction of the axis 4.

Figure 7:
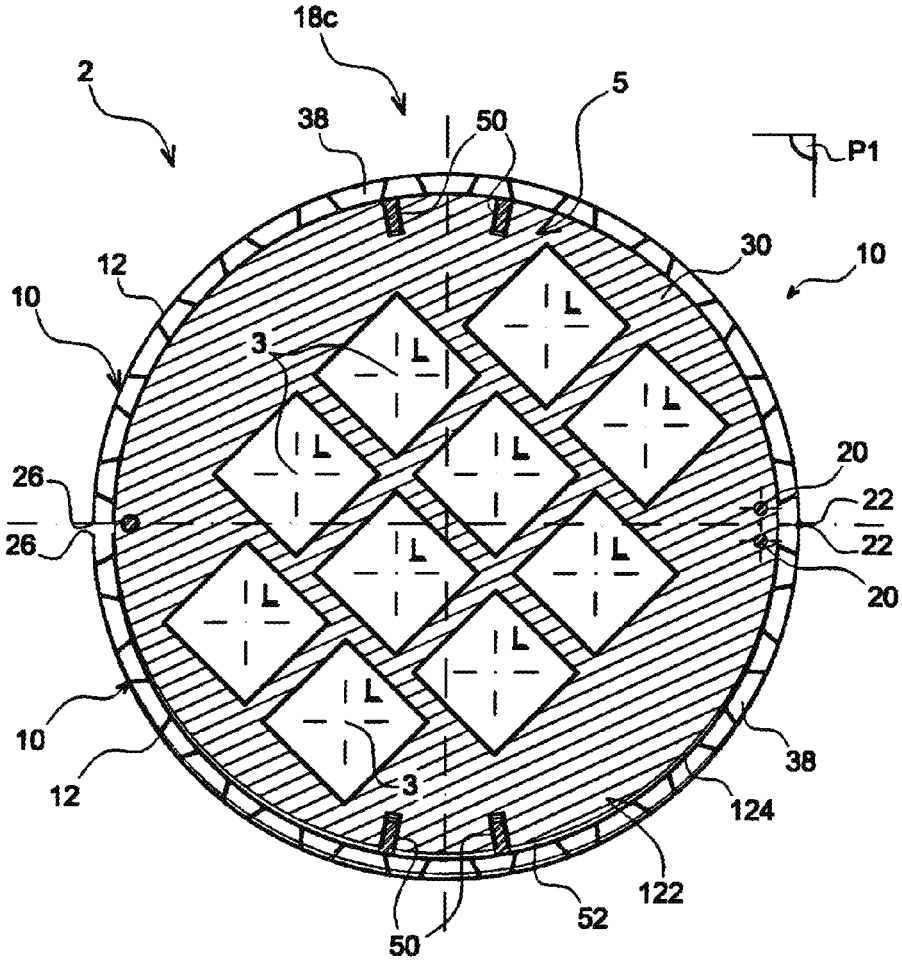
FIG. 7 illustrates a transverse sectional view of the storage space device, taken along the line VII-VII of FIG. 6, one of the mobile heat conduction components being illustrated in the retracted position and the other one in the deployed position.

The permanent contact between the guiding ramp 46 and its associated pin 48 is obtained via elastic return means of the spring type, preferably a compressive spring. This is shown as an illustrative example in FIG. 7, showing the presence of springs 50 between the mobile components and the main structure 5, and more specifically between the hollow cylinder portion 38 and one or more of the wafers 30. Naturally the number and the arrangement of the springs 50 are determined depending on the encountered needs and constraints, their action tending to push the mobile heat conduction components 10 towards their deployed position.

It is noted that in FIG. 7, the upper mobile component 10 is illustrated in its retracted position, while the lower mobile component 10 is illustrated in its deployed position in which it is moved away from the main structure 5, as shown by the free space 52 between the hollow cylinder portion and the periphery of the wafers 30.

With such a configuration, when the modules 44 are automatically displaced in response to the rotation of the rod 40, each guided pin 48 moves along its associated tilted ramp 46 with which it retains contact, by means of the permanently exerted action by the springs 50. This is observed both when it is desired to move the components 10 towards their retracted position, i.e. when the exerted rotation of the rod 40 leads to bringing the pins 48 closer to the rod 40, and when it is desired to move the components 10 towards their deployed position, i.e. when the exerted rotation of the rod 40 leads to moving away of the pins 48 from this rod 40. The latter phase in particular expresses the fact that the free edges 26 move away from the main structure 5, following pivoting of the components 10 about their respective joint axis 20.

Finally, it is indicated, as shown in FIG. 6 for section 18*c*, that each mobile component 10 is equipped with two longitudinally spaced guided pins 48, each of them cooperating with a distinct retaining module 44.

Figure 8:
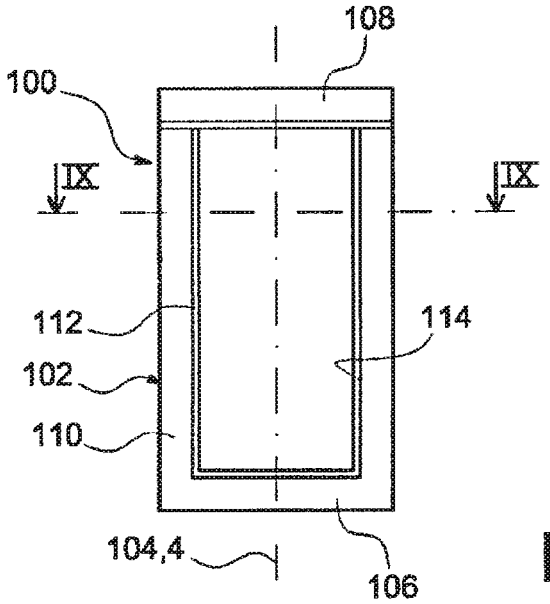
FIG. 8 shows a schematic longitudinal sectional view of a container for the transport and/or storage of nuclear fuel assemblies, comprising the storage space device shown in the previous figures.

With reference to FIG. 8, a container 100 is seen, also object of the present invention, globally comprising a package 102 inside which a storage space device 2 is found, as described above. The device 2 is provided in order to be placed in a cavity 112 of the package 102, as schematically shown in FIG. 8 in which it is also possible to see the longitudinal axis 104 of the package 102 coinciding with the longitudinal axis 4 of the storage space device, this package 102 essentially having a bottom 106 on which the device 2 is intended to rest in the vertical position, a lid 108 and a side body 110 extending around the longitudinal axis 104.

It is this side body 110 which defines the housing cavities 112, with a side inner surface 114 of a substantially cylindrical shape and with a circular section, and with an axis coinciding with the aforementioned axes 104 and 4.

The method for loading the device 2 into the package 102, also object of the present invention, will be described with reference to FIGS. 8-9*b*.

First of all, before introducing the basket in the housing cavity 112, the mobile components 10 are displaced in their retracted position with control means described earlier, in order to better facilitate this operation for introducing the basket, generally performed vertically.

Figure 9A:
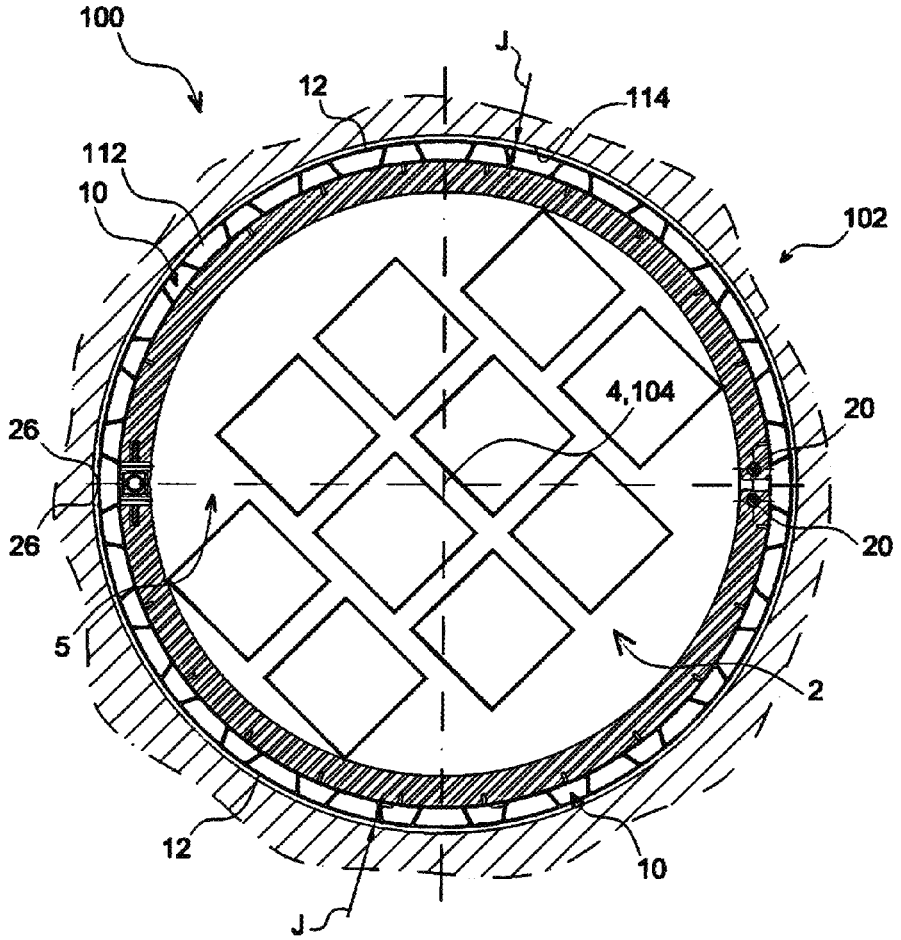
FIG. 9*a* illustrates a schematic transverse sectional view of the storage space device, taken along the line IX-IX of FIG. 8, the mobile heat conduction components being illustrated in the retracted position.

Once this introduction is achieved, the basket 2 is found in the configuration schematically shown in FIG. 9*a*, in which its side outer surface, i.e. the surfaces 12 of the mobile components 10, are moved away from the side inner surface 114 delimiting the housing cavity 112. Reference J placed between the surfaces 12 and 114 therefore symbolizes the presence of an initial large play between the basket and the cavity of the package, before deployment of the mobile heat conduction structure.

Figure 9B:
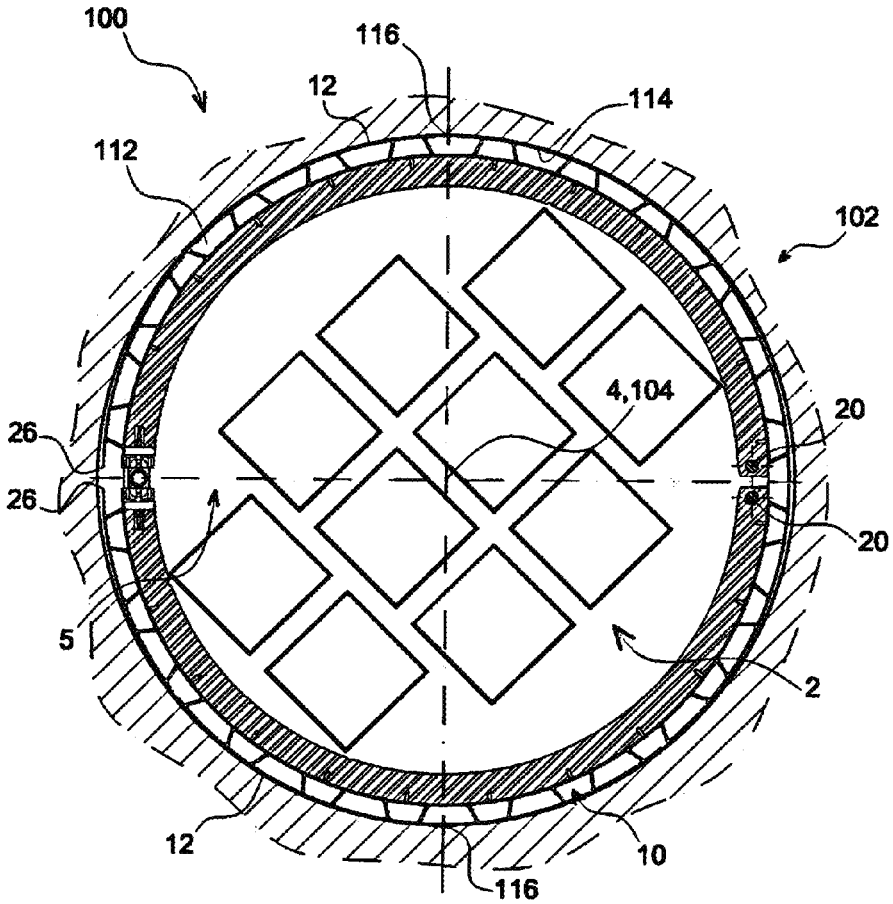
FIG. 9*b* illustrates a schematic transverse sectional view of the storage space device, taken along the line IX-IX of FIG. 8, the mobile heat conduction components being illustrated in the deployed position.

Therefore, a subsequent step for deploying this mobile heat conduction structure is applied so that each mobile heat conduction component 10 of the latter will come into contact with the inner side surface 114 in order to ensure the heat transfer function, as shown in FIG. 9*b*.

This is achieved by the actuation of the control means by an operator, which causes, under the action of the springs provided for this purpose, the simultaneous pivoting of the mobile components 10 about their joint axis 20, so that they move away from the axis 4.

The contact obtained between each mobile component 10 and the cavity 112 assumes the shape of a linear contact along a generatrix common to the surfaces 12 and 114, a schematically shown by references 116 in FIG. 9*b*.

Figure 10:
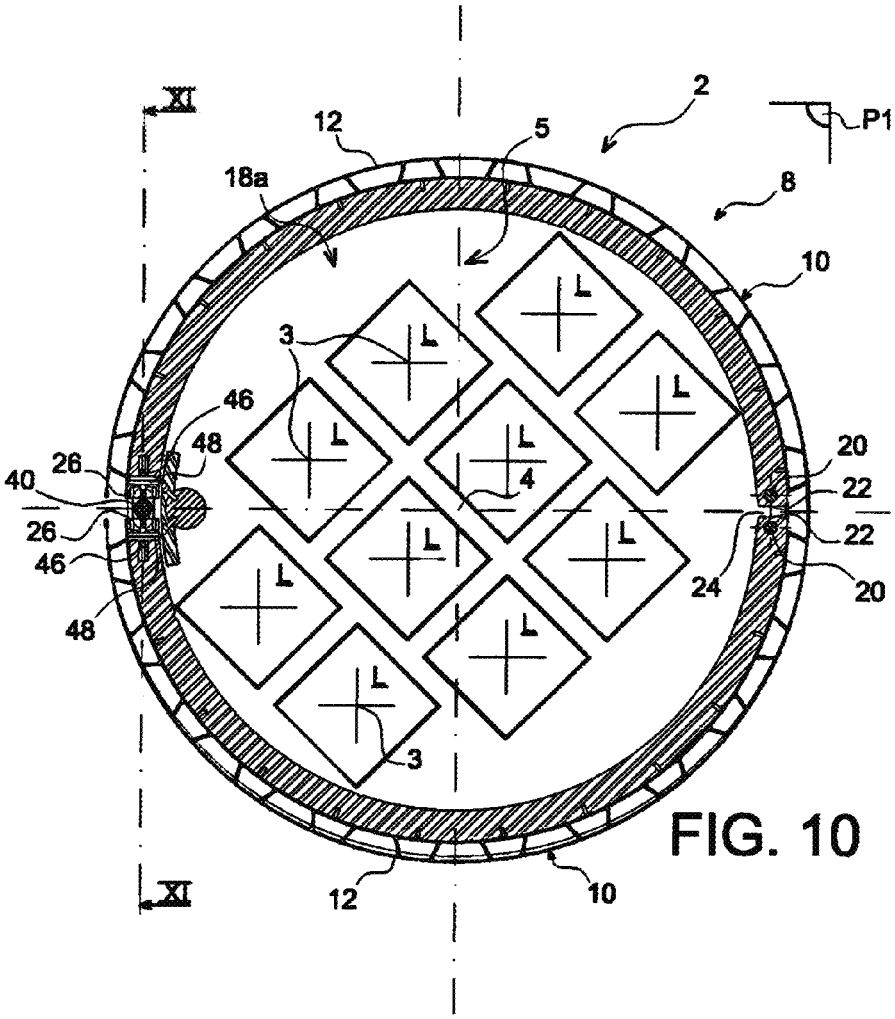
FIG. 10 illustrates a detailed transverse section view of the storage space device shown in the configuration of FIG. 9*b;*

The free longitudinal edges 26 initially facing each other two by two are therefore moved away from each other, in the sense that they follow the movement of the mobile components 10 moving away from the axis 4 and from the main structure 5, as shown in FIG. 10.

Figure 11:
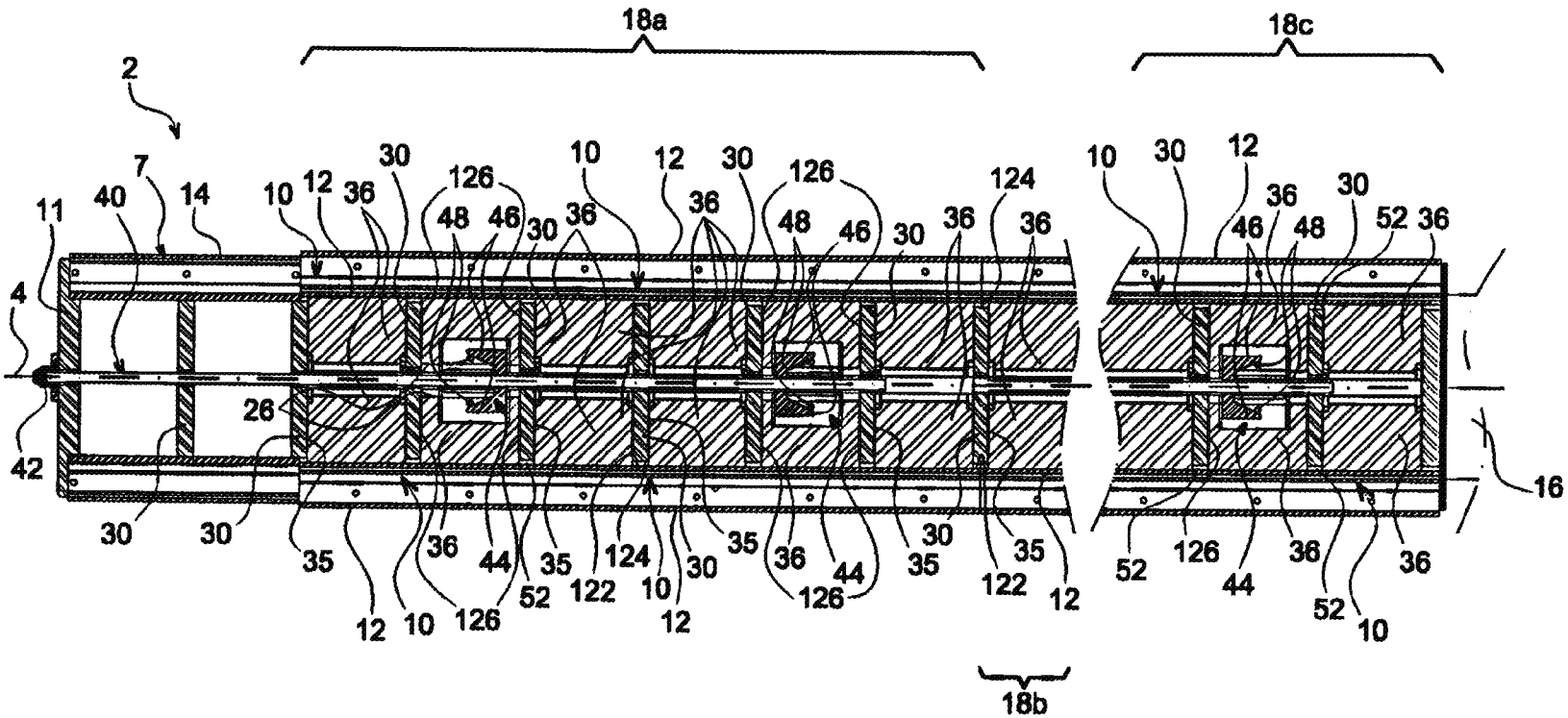
FIG. 11 illustrates a longitudinal sectional view of the storage space device, taken along the line XI-XI of FIG. 10.

The deployment of the mobile components 10 shows the free space 52, which is located between the side inner surface 122 of the hollow cylinder portion of the relevant mobile component 10, and the circumferential supporting surface 124 defined by the periphery of the wafers 30, as visible in FIG. 11. However, in order to guarantee heat transfer between the main structure 5 and the mobile heat conduction components 10, it is provided that in the deployed position shown in this FIG. 11, the semi-annular internal portions 36 continue to be partly in contact with the two wafers 30 located on either side of each portion 36. The two surface contacts observed for each internal portion 36 of the mobile components 10 are respectively located in two distinct transverse planes, and referenced as 126 in FIG. 11 also showing the new relative position of the guided pins 48, with respect to their respective ramps 46 with which they are in contact.

Once the mobile structure 8 is deployed, the cavity 112 is then closed by the lid 108 of the container.

Figure 12A:
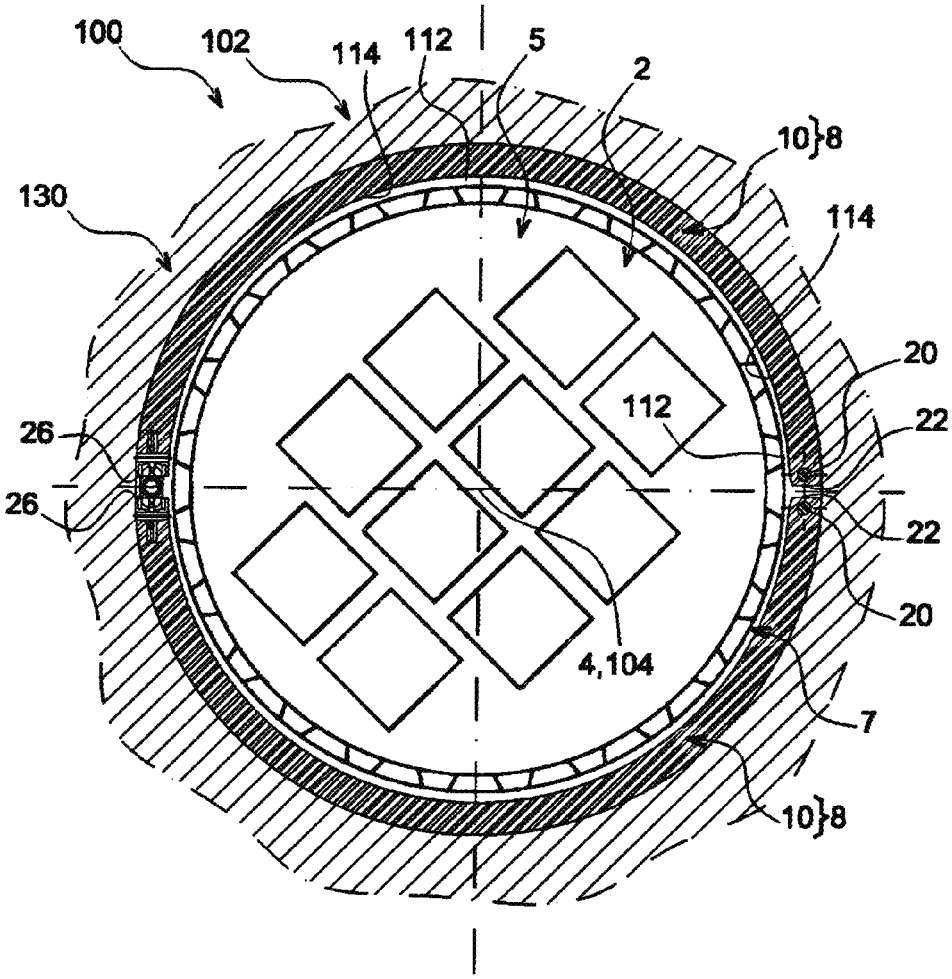
FIGS. 12*a* and 12*b* show schematic views similar to those shown in FIGS. 9*a* and 9*b*, with the container appearing in the form of another preferred embodiment of the present invention.
Figure 12B:
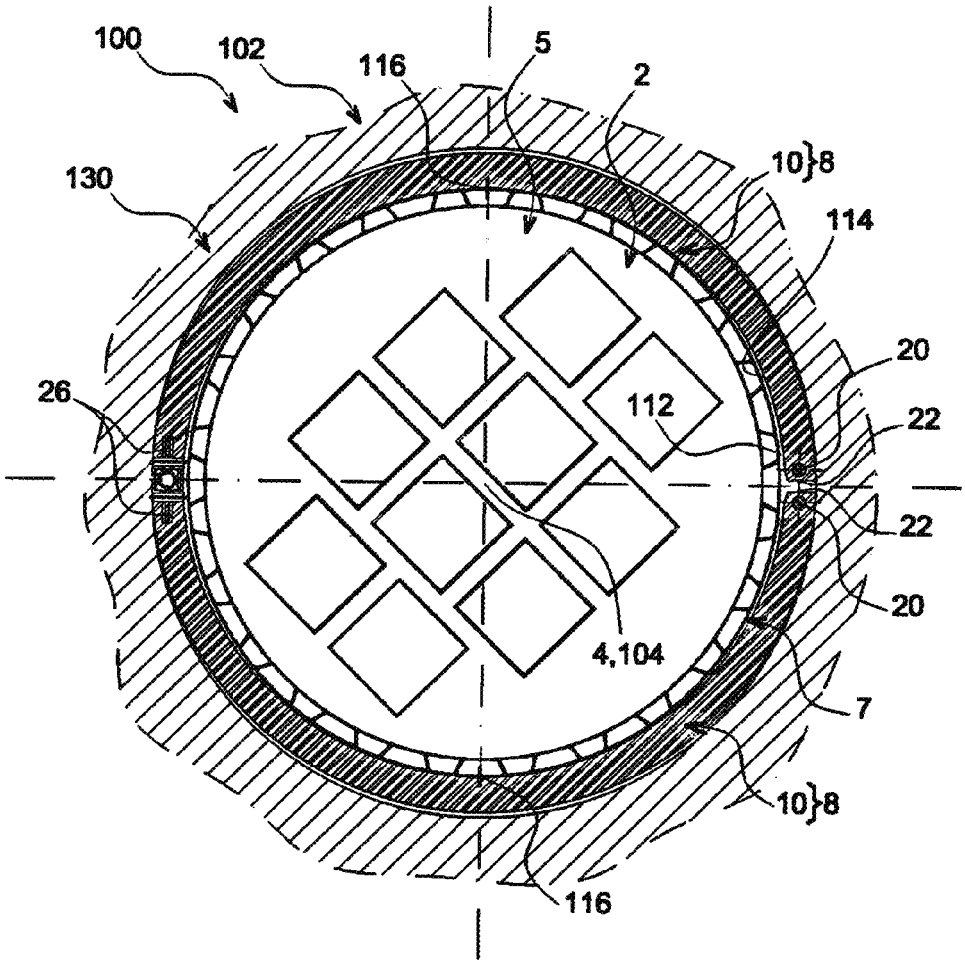

Referring now to FIGS. 12*a* and 12*b*, the container 100 is found in the form of another preferred embodiment, in the sense it is the package 102 which bears the mobile heat conduction structure 8 and not the storage space device 2 as this was the case in the previous embodiment.

The whole of the technical characteristics relating to the basket 2 described earlier may be applied identically or similarly to the package 102 which will be shortly presented hereafter and which is also object of the present invention.

Thus, the side inner surface 114 delimiting the housing cavity 112 is at least partly defined by the side inner surfaces of the mobile heat conduction components 10, which are presently jointedly mounted on the main structure 130 of the package, and more specifically on an inner peripheral portion of the latter.

Each mobile component 10 is then mounted on the main structure 130 so as to be displaceable from a retracted position shown in FIG. 12*a*, to a deployed position shown in FIG. 12*b*, while moving closer to the longitudinal axis 104 of the housing cavity 112, therefore while moving away from the main structure 130 radially inwards.

In these two figures, it may be seen that unlike the previous embodiment, in the retracted position of the components 10, the free longitudinal edges 26 facing each other two by two are substantially moved away from each other, while, in the deployed position of the components 10 allowing contact 116 with the side outer surface 7 of the basket 2, the free longitudinal edges 26 facing each other two by two are substantially brought closer to each other, or even in contact two by two.

Of course, various modifications may be made by one skilled in the art to the invention which has just been described, exclusively as non-limiting examples.

The invention claimed is:

1. A container for the transport and/or storage of nuclear materials, comprising:

a storage space device having a main structure defining at least one housing (L) intended to contain said nuclear materials, and a package having a cavity delimited by a side inner surface and a lid closing the cavity to form a closed cavity, said storage space device configured to be slidably introduced into said cavity, the storage space device being removably placed inside said cavity of the package, and when the storage device is placed in the cavity it is integrally enclosed in said cavity, wherein the container is formed such that it also includes a mobile heat conduction structure forming at least one portion of a side outer surface of said storage space device, said mobile heat conduction structure comprising at least one mobile heat conduction component mounted on said main structure so as to be displaceable reversibly, from a retracted position to a deployed position, while moving away from said main structure, wherein play is reduced between said side inner surface and said side outer surface, or contact between said side inner surface and said outer surface is obtained or increased.

2. The container according to claim 1, characterized in that in at least one longitudinal half-section of the storage space device passing through a longitudinal axis of the latter and crossing the mobile heat conduction structure, the sum of the lengths of each mobile component of the crossed mobile structure, along the longitudinal axis of the storage space device, accounts for at least 20% of a total length of said storage space device along its longitudinal axis.

3. The container according to claim 1, characterized in that at least one mobile component is jointedly mounted on said main structure, along a joint axis parallel to a longitudinal axis of said storage space device.

4. The container according to claim 3, characterized in that said joint axis crosses a peripheral portion of said main structure.

5. The container according to claim 1, characterized in that the side outer surface of at least one mobile component assumes the shape of an angular portion of a cylindrical surface with a longitudinal axis parallel to a longitudinal axis of said storage space device, said angular portion being less than or equal to 180°.

6. The container according to claim 1, characterized in that at least one mobile component is jointed on said main structure at a longitudinal edge of this component.

7. The container according to claim 1, characterized in that around a given longitudinal portion of said main structure, said mobile structure has a plurality of mobile heat conduction components distributed peripherally.

8. The container according to claim 7, characterized in that in the retracted position of each of said plurality of mobile heat conduction components, the latter form a peripheral casing around said given longitudinal portion.

9. The container according to claim 8, characterized in that said peripheral casing of the given longitudinal portion is formed by two, three or four mobile heat conduction components.

10. The container according to claim 1, characterized in that said mobile heat conduction structure comprises a plurality of mobile heat conduction components distributed along a longitudinal direction of the storage space device.

11. The container according to claim 1, characterized in that the storage space device further comprises elastic return means returning at least one mobile heat conduction component towards its retracted position or towards its deployed position.

12. The container according to claim 1, characterized in that the storage space device further comprises control means with which the displacement of each mobile heat conduction component may be generated from its retracted position to its deployed position, and vice versa, said control means being actuatable from the outside of the storage space device.

13. The container according to claim 12, characterized in that said control means comprise a control rod crossing said main structure parallel to a longitudinal axis of said storage space device.

14. The container according to claim 1, characterized in that it is applied to the transport and/or storage of fresh nuclear fuel assemblies.

15. A container for the transport and/or storage of nuclear materials, comprising:

a package comprising a main structure and a housing cavity being delimited by a side inner surface of said package and a lid closing the housing cavity to form a closed housing cavity; and a storage space device configured to be slidably introduced into said housing cavity, the storage space device being placed inside said housing cavity, and when the storage device is placed in the housing cavity it is integrally enclosed in said housing cavity, wherein the container also includes a mobile heat conduction structure forming at least one portion of said side inner surface of the package, said mobile heat conduction structure comprising at least a mobile heat conduction component mounted on said main structure so as to be displaceable, reversibly, from a retracted position to a deployed position while moving closer to a longitudinal axis of said housing cavity.

* * * * *